United States Patent [19]

Abe et al.

[11] Patent Number: 4,550,588

[45] Date of Patent: Nov. 5, 1985

[54] PRESS MACHINE

[75] Inventors: Toshio Abe; Terushige Sakurai, both of Komatsu, Japan

[73] Assignee: Kabushiki Kaisha Komatsu Seisakusho, Tokyo, Japan

[21] Appl. No.: 448,172

[22] Filed: Dec. 9, 1982

[51] Int. Cl.[4] ..... B21J 7/46

[52] U.S. Cl. ..... 72/441; 72/447; 72/404; 72/456; 72/472

[58] Field of Search ..... 72/441, 442, 444, 481, 72/469, 472, 389, 404, 456, 455, 333, 447

[56] References Cited

U.S. PATENT DOCUMENTS

| | | | |
|---|---|---|---|
| 144,969 | 11/1873 | Evans | 72/404 |
| 560,515 | 5/1896 | Mason | 72/481 |
| 2,225,145 | 12/1940 | Baumbach | 74/456 |
| 3,491,576 | 1/1970 | Oguri | 72/404 |
| 3,948,077 | 4/1976 | Bothe | 72/441 |
| 4,148,209 | 4/1979 | Bessho | 72/441 |
| 4,322,994 | 4/1982 | Muhr et al. | 72/481 |

FOREIGN PATENT DOCUMENTS 56-137823 3/1980 Japan .

*Primary Examiner*—Daniel C. Crane
*Assistant Examiner*—David B. Jones
*Attorney, Agent, or Firm*—Armstrong, Nikaido, Marmelstein & Kubovcik

[57] ABSTRACT

A press machine adapted for the production of many different types of products in limited quantities. The press machine comprises a plurality of lower dies mounted on a bolster and a plurality of upper dies each mounted to a slide facing to the respective lower dies. Each upper die is mounted to the slide by means of a die clamper via an adapter plate and each upper die is biased upwards by coil springs so that a predetermined gap exists between each pair of upper and lower dies when the slide is moved down to a bottom dead center. An activating plate can be insertable between the slide and each adapter plate so that the activated upper die is allowed to make contact with the opposing lower die.

3 Claims, 1 Drawing Figure

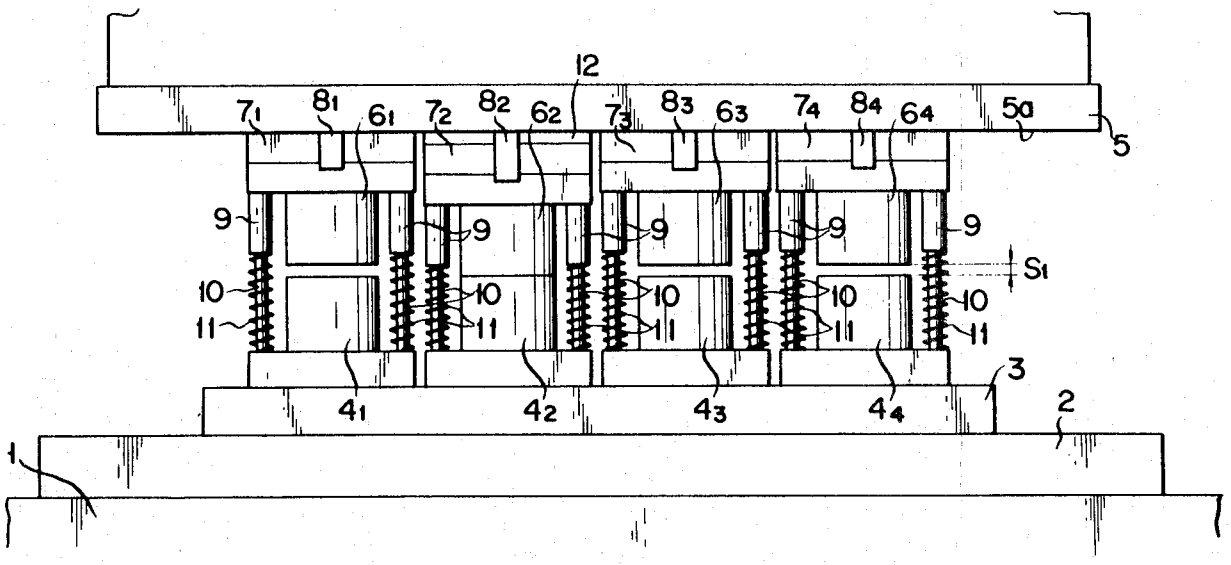
5
5a
S1
9
10
11
3
2
64
84
74
44
63
83
73
43
12
62
82
72
42
61
81
71
41
1

PRESS MACHINE

BACKGROUND OF THE INVENTION

This invention relates to a press machine, and more particularly to a press machine suitable for the production of multi-articles in limited quantities.

The prior art press machine comprises, in general, upper dies mounted to a slide and lower dies mounted to a bed, said upper dies being located opposite to said lower dies, the arrangement being made such that blanks are supplied in turn between the upper and lower dies and then pressed in a desired shape by moving the upper dies towards the lower dies.

Accordingly, in case of producing multi-articles each of which is not mass-produced by means of one press machine, the upper and lower dies must be replaced with ones corresponding in shape to the articles to be produced. Therefore, troublesome die replacement operations are inevitably required, and also because of the suspension of operation of the press machine which is unavoidable for the replacement of the dies, the production efficiency will fall remarkably.

SUMMARY OF THE INVENTION

It is therefore an object of the present invention to provide a press machine which is specifically adapted for the production of many different types of products each in a small quantity.

In accordance with an aspect of the present invention, there is provided a press machine, comprising: a bed; a bolster mounted on said bed; a plurality of lower dies each mounted on said bolster; a slide movable towards and away from said bed; a plurality of upper dies movably mounted to said slide each facing said respective lower dies; a plurality of die clamper means each for mounting said respective upper dies to said slide; a plurality of adapter means each disposed between said respective upper dies and said slide in such a manner that a predetermined gap exists between each pair of said upper and lower dies when said slide is moved down to a bottom dead center of the press with each of said adapter means making contact with said slide; a plurality of biasing means each for biasing said respective upper dies towards said adapter means so that said respective adapter means make contact with said slide; and activating means selectively insertable between any of said adapter means and said slide so that said activated upper die or dies are allowed to make contact with said opposing lower die or dies.

The above and other objects, features and advantages of the present invention will be readily apparent from the following description taken in conjunction with the accompanying drawing.

BRIEF DESCRIPTION OF THE DRAWING

The sole FIGURE is a fragmentary schematic drawing showing a front elevational view of a press machine according to the present invention.

DESCRIPTION OF THE PREFERRED EMBODIMENT

The present invention will now be described below by way of example only with reference to the accompanying drawing.

A bolster 2 is mounted on a bed 1. A plurality of lower dies $\mathbf{4}_1$, $\mathbf{4}_2$, $\mathbf{4}_3$ and $\mathbf{4}_4$ are mounted through a common base 3 on the bolster 2. Further, a vertically movable slide 5 is located opposite the bed 1.

The slide 5 has a plurality of upper dies $\mathbf{6}_1$, $\mathbf{6}_2$, $\mathbf{6}_3$ and $\mathbf{6}_4$ fitted thereto opposite the respective lower dies 4hd 1, $\mathbf{4}_2$, $\mathbf{4}_3$ and $\mathbf{4}_4$.

Stating in more detail, the upper dies $\mathbf{6}_1$, $\mathbf{6}_2$, $\mathbf{6}_3$ and $\mathbf{6}_4$ are clamped or fixedly secured to the lower surface 5*a* of the slide 5 by means of die clampers $\mathbf{8}_1$, $\mathbf{8}_2$, $\mathbf{8}_3$ and $\mathbf{8}_4$, respectively through respective adapter plates $\mathbf{7}_1$, $\mathbf{7}_2$, $\mathbf{7}_3$ and $\mathbf{7}_4$. Each of the upper dies $\mathbf{6}_1$, $\mathbf{6}_2$, $\mathbf{6}_3$ and $\mathbf{6}_4$ has a pair of guides 9, 9 mounted thereto. Slidably inserted in the pair of guides 9, 9 are a pair of guide posts 10, 10 which stand upright on each of the lower dies $\mathbf{4}_1$, $\mathbf{4}_2$, $\mathbf{4}_3$ and $\mathbf{4}_4$. Each of the guides 9 is biased upwardly by the force of a spring 11 interposed between each of the lower dies $\mathbf{4}_1$, $\mathbf{4}_2$, $\mathbf{4}_3$ and $\mathbf{4}_4$ and each of the guides 9 thereby keeping a clearance $S_1$ between the upper dies $\mathbf{6}_1$, $\mathbf{6}_2$, $\mathbf{6}_3$ and $\mathbf{6}_4$ and the lower dies $\mathbf{4}_1$, $\mathbf{4}_2$, $\mathbf{4}_3$ and $\mathbf{4}_4$, respectively. Each of the lower dies $\mathbf{4}_1$ to $\mathbf{4}_4$ and upper dies $\mathbf{6}_1$ to $\mathbf{6}_4$ is made different in shape.

The operation of the press machine will now be described below.

First, a pair of or pairs of lower dies $\mathbf{4}_1$ to $\mathbf{4}_4$ and upper dies $\mathbf{6}_1$ to $\mathbf{6}_4$ corresponding in shape to the article to be produced in limited quantities are set. For example, if the pair of dies $\mathbf{6}_2$ and $\mathbf{4}_2$ is selected, then an activating plate 12 is interposed between the upper die $\mathbf{6}_2$ and the lower surface 5*a* of the slide 5 so that the upper die $\mathbf{6}_2$ may contact with the lower die $\mathbf{4}_2$ when the slide 5 is lowered to the bottom dead center.

Then, a blank is supplied only between the lower die $\mathbf{4}_2$ and the upper die $\mathbf{6}_2$ and the slide 5 is driven so that the supplied blank can be pressed in a desired shape.

Because, at that time, the clearance $S_1$ is maintained between the other pairs of upper and lower dies, other upper dies $\mathbf{6}_1$, $\mathbf{6}_3$ and $\mathbf{6}_4$ do not strike the corresponding lower dies $\mathbf{4}_1$, $\mathbf{4}_3$ and $\mathbf{4}_4$. Therefore, the generation of noise due to such ineffective strikes and the shortening of the life-time of the dies resulting therefrom can be eliminated.

Further, in case of producing articles having a different shape, an activating plate 12 is interposed between the upper die 6 corresponding in shape to the article to be produced and the lower surface 5*a* of the slide 5, and then a blank is supplied only between the activated upper die 6 and the lower die 4.

Then, the slide 5 is driven so that the blank can be pressed in the desired shape without causing any ineffective strikings of the other pairs of upper and lower dies which are not supplied with blanks.

Moreover, when it is desired to produce a plurality of articles at the same time, an activating plate 12 is interposed between each of a plurality of upper dies selected to be used and the lower surface 5*a* of the slide 5 and then blanks are fed between the activated upper dies and the lower dies.

Then, the slide 5 is driven so that the plurality of articles can be produced at the same time without causing any ineffective strikings of the other pairs of upper and lower dies to which no blank is supplied.

Thus, multi-articles can be pressed by means of only one press machine without having to replace the dies each time production of articles different in shape is required. Accordingly, the production efficiency can be much improved, and also ineffective strikings of the other pairs of upper and lower dies to which no blank is supplied can be eliminated. Therefore, the generation of noise due to such ineffective strikings of the dies and the shortening of the life-time of the dies caused thereby can be eliminated.

Since the present invention is constructed as mentioned hereinabove, production of multi-articles in limited quantities can be conducted efficiently by means of only one press machine without causing any ineffective strikings of the pairs of upper and lower dies which are not supplied with blanks. Therefore, the generation of noise due to such ineffective strikings and the shortening of the life-time of the dies resulting from the repetition of such ineffective strikings can be eliminated.

It is to be understood that the foregoing description is merely illustrative of preferred embodiment of the invention, and that the scope of the invention is not to be limited thereto, but is to be determined by the scope of the appended claims.

What is claimed is:

1. A press machine, comprising:

a bed;

a bolster mounted on said bed;

a plurality of lower dies each mounted on said bolster;

a slide movable towards and away from said bed;

a plurality of upper dies movably mounted to said slide each facing said respective lower dies;

a plurality of die clamper means each for mounting said respective upper dies to said slide;

a plurality of adapter means each disposed between said respective upper dies and said slide in such a manner that a predetermined gap exists between each pair of said upper and lower dies when said slide is moved down to a bottom dead center of the press with each of said adapter means making contact with said slide;

a plurality of biasing means each for biasing said respective upper dies towards said adapter means so that said respective adapter means make contact with said slide; and activating means selectively insertable between any of said adapter means and said slide so that said activated upper die or dies are allowed to make contact with said opposing lower die or dies.

2. A press machine according to claim 1 wherein each of said upper and lower die pairs has two biasing means each mounted on an opposite side of said respective upper and lower die pairs and wherein each of said biasing means comprises a tubular guide fixedly secured at one end to said respective upper dies, a guide post having one end fixedly secured to said respective lower dies and the other end being inserted within said guide and slidable therein, and a coil spring disposed around said guide post between said guide and said respective lower dies.

3. A press machine according to claim 1 further comprising a die base mounted on said bolster for supporting all of said lower dies.

* * * * *